US005762050A

United States Patent [19]

Gonzalez

[11] Patent Number: 5,762,050

[45] Date of Patent: Jun. 9, 1998

[54] FUEL SYSTEMS FOR AVGAS WITH BROAD VOLATILITY

[75] Inventor: Cesar Gonzalez, Wichita, Kans.

[73] Assignee: The Cessna Aircraft Company, Wichita, Kans.

[21] Appl. No.: 710,462

[22] Filed: Sep. 17, 1996

[51] Int. Cl.[6] ..... F02M 37/04

[52] U.S. Cl. ..... 123/516; 123/518

[58] Field of Search ..... 123/516, 518; 137/587, 588, 589; 220/746

[56] References Cited

U.S. PATENT DOCUMENTS

| | | | |
|---|---|---|---|
| 4,844,704 | 7/1989 | Jiro | 123/516 |
| 5,103,793 | 4/1992 | Riese et al. | 123/516 |
| 5,368,001 | 11/1994 | Roche | 123/516 |
| 5,389,245 | 2/1995 | Jaeger et al. | 123/516 |
| 5,579,740 | 12/1996 | Cotton et al. | 123/516 |

*Primary Examiner*—Thomas N. Moulis
*Attorney, Agent, or Firm*—Edward L. Brown, Jr.

[57] ABSTRACT

A fuel injection type aircraft fuel system for piston aircraft engines including a gravity flow fuel tank in the aircraft; a pressurized fuel metering unit on the aircraft engine; a fuel line connecting the metering unit to the fuel tank; an engine driven pump in said fuel line positioned in the engine compartment; a vapor separator in said fuel line between the engine driven pump and the fuel metering unit; a first vapor vent line connecting the vapor separator to the fuel tank; a fuel reservoir in said fuel line between the fuel tank and the engine driven pump; a submerged auxiliary pump in said reservoir to charge said system; an auxiliary pump bypass valve connected and parallel to said auxiliary pump; and a second vapor vent line connecting the reservoir to the fuel tank.

5 Claims, 3 Drawing Sheets

FUEL SYSTEMS FOR AVGAS WITH BROAD VOLATILITY

The present invention relates to aircraft fuel systems and more specifically to systems featuring engine fuel injection means, which can handle the broad volatility characteristics of the newly proposed unleaded Grade 82UL, and traditional ASTM D910 aviation gasolines.

BACKGROUND OF THE INVENTION

A variety of airplanes in the current general aviation fleet featuring low octane engines with carburetors, are operating without vapor problems on motor gasolines of broad volatility characteristics. "Motor gasolines" include all road vehicle gasolines. ASTM D910 aviation gasolines include Grades 80–87, 100–130 and 100LL (low lead) products. However, most fuel injected engines are not compatible with the proposed Grade 82UL fuels based on motor gasoline stocks covering a broad range of volatility characteristics and a limited number of engines fitted with carburetors have shown similar incompatibilities on specific aircraft installations.

Some high performance aircraft fuel injected engines require 100 octane aviation gasoline to operate, and tetraethyl lead additives which are indispensable to achieve 100 octane ratings, are no longer acceptable for environmental reasons and must be replaced with alternate unleaded fuels. One proposed alternative, is the lower octane Grade 82UL aviation gasoline based on motor gasoline stocks currently under evaluation on lower compression engines. As is the case with the motor gasolines from which it is based, the proposed Grade 82UL aviation gasoline offers a broad range of volatility characteristics, and fuels covering the high volatility end of that range have been demonstrated to be incompatible with conventional aircraft engine fuel injection and associated airframe systems. Evolution of vapor under hot ambient conditions exceeds the purging capacity of these systems, resulting in the development of vapor, lock on the engine and supply system pumps, One prior art method that provided partial relief to this problem utilized a recirculating fuel system which could pump cool fuel from the tank through the entire system, including the hot engine and engine compartment , thus purging vapors back to the tank while cooling, various fuel injection system components. However, with fuels exhibiting Reid vapor pressures approximately above 8.5 PSI, this recirculated fuel could not purge vapors at rates commnensurate with their evolution and it raised the temperature of the fuel in the tanks, thus compounding the problem. Partial, but not total relief to vapor lock problems have also been provided by insulating lines within the hot engine compartment, insulating fuel injection components from the hot engine itself, and air cooling, some or all of the same components. Submerged electric fuel pumps installed in the fuel tanks have been adopted on a large n,umber of aircraft, and represent the standard solution approach on modern fuel injected automobiles. However, while very effective in solving vapor problems, this approach pressurizes the entire fuel system and due to safety considerations is not considered an acceptable solution for many aircraft types, where the fuel supply lines from the tank to the engine must traverse the pilot and passenger compartments.

Under hot ambient conditions, motor gasolines or the proposed Grade 82UL aviation gasoline have volatility characteristics more severe than traditional ASTM D-910 aviation gasolines limited by the specification to a maximum Reid vapor pressure of 7.5 PSI, and therefore the engine fuel injection and associated airframe systems for these more volatile gasolines must be capable of purging vapors which may develop and accumulate in various components in the system so the engine does not experience partial or total power loses due to vapor lock conditions.

SUMMARY OF THE INVENTION

The present invention solves these vapor problems with engine fuel injection and associated airframe systems for a broad volatility range of aviation gasolines, which removes the vapor from various locations in the fuel system and improves the vapor handling characteristics of the auxiliary fuel pump remotely installed from the fuel tank.

The new system is devoid of fuel recirculation back to the tank thus avoiding tank bulk fuel temperature rises, reduces supply lines fuel flow velocities and corresponding pressure losses, and does not require complex selector valves. The new system only returns vapor to the tank or tanks.

The submerged auxiliary fuel pump, fuel pump by-pass valve, and pressure relief valve are installed within a small vented fuel reservoir. While the auxiliary fuel pump and pump by-pass valve draw liquid fuel from the lower part of the reservoir, the vapors collected above the fuel in the top of the reservoir are vented back to the tanks. Fuel vapor that develops in lines and engine fuel injection components within the engine compartment are accumulated in a pressurized vapor separator located on a relatively high level of the system downstream of the engine driven fuel pump and vented under pressure back to the fuel tanks.

One of the safety features of the present fuel system is that it eliminates or reduces to an absolute minimum the length of pressurized fuel lines located within the occupied cabin compartment of certain types of aircraft. With the elimination of recirculated fuel back to the tanks, these pressurized lines and the associated tank return selector valve provisions are also eliminated.

It is, therefore, the principal object of the present invention to provide an engine fuel injection system which can handle a broad volatility range of aviation gasolines, including those based on motor gasolines having a Reid vapor pressure as high as 14.5 PSI.

Another object of the present invention is to provide an engine fuel injection and associated airframe fuel system without circulating fuel flow back to the tanks.

Another object of the present invention is to provide an engine fuel injection system utilizing a pressurized vapor separator in the engine compartment of the aircraft.

A further object of the present invention is to provide an integrated module consisting of a vented fuel reservoir, submerged auxiliary pump, by-pass valve and pressure relief valve all within said reservoir adopted for use with an engine carburetor system.

These and other objects and advantages of the present invention will be more apparent from the following description and drawings in which:

DETAILED DESCRIPTION OF THE PREFERRED EMBODIMENTS

Figure 1:
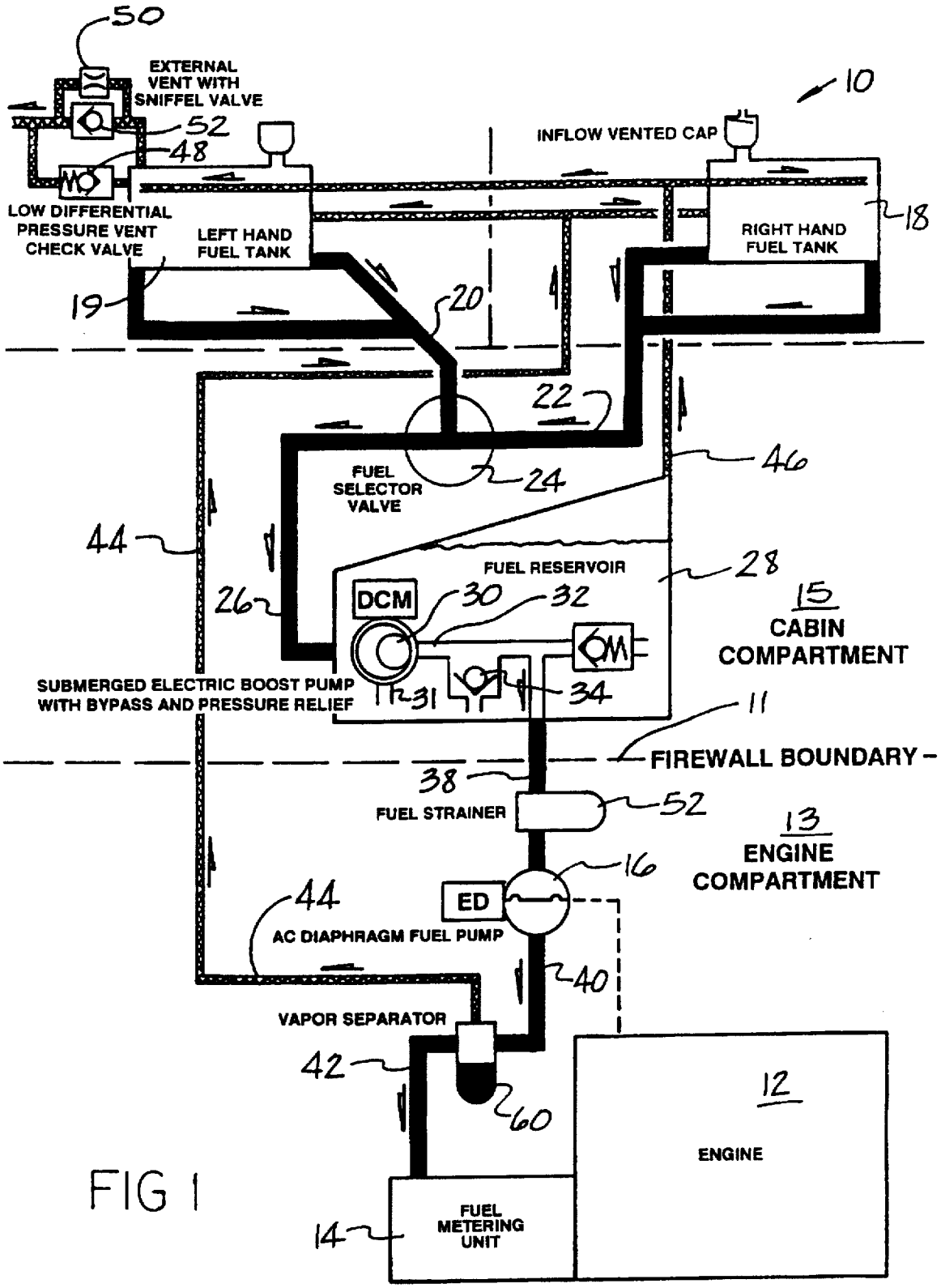
FIG. 1 is a schematic diagram of all of the components in the fuel system and their relative positions in the aircraft.
Figure 3:
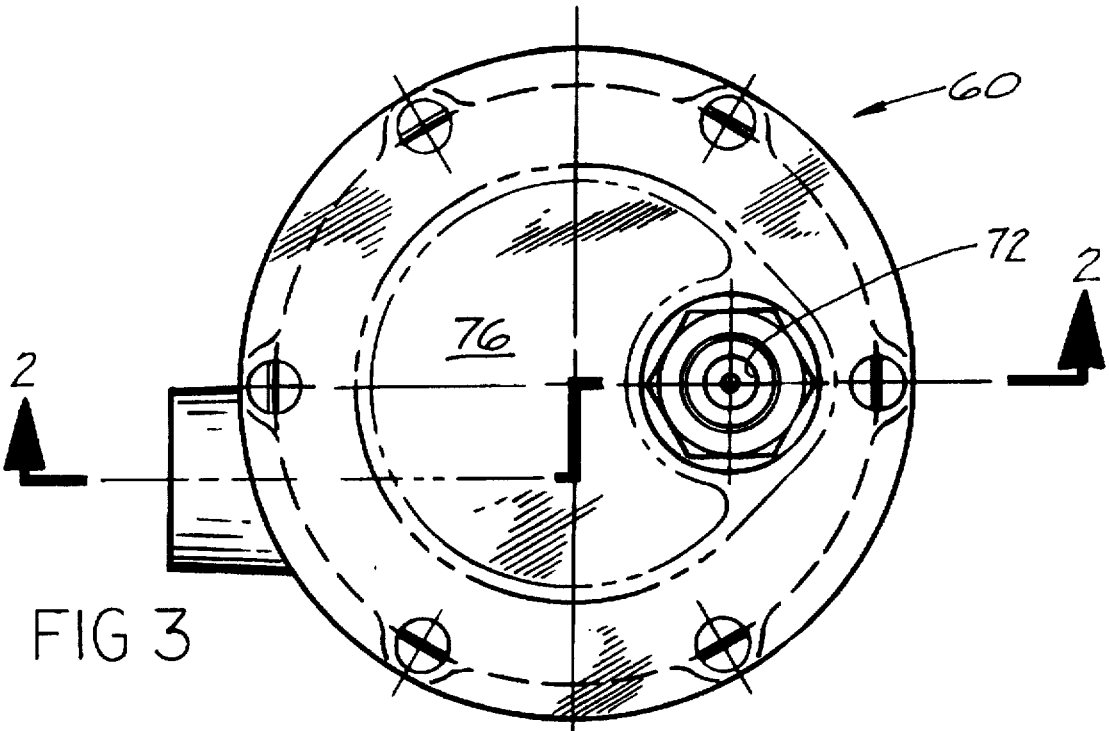
FIG. 3 is a top view of the vapor separator.

Referring to the accompanying FIG. 1 wherein all of the components are represented by either functional blocks or symbols, the overall fuel system is generally recognized by reference numeral 10. The fuel system 10 supplies a piston aircraft engine 12 with fuel from portions of the system in the engine compartment 13 and the cabin compartment 15 which also includes the wings, not shown, which contain the right- and left-hand fuel tanks 18 and 19 respectively. The fuel system 10 is a fuel injection type system, as distinguished from a carbureted system, including two pumps 16 and 30 for moving the fuel through the system. The system then supplies a fuel metering unit 14 which is conventional in design and is controlled by a manual throttle and mixture control, also not shown in the drawing.

Both fuel tanks 18 and 19 include a pair of fuel lines exiting from opposite sides of the tank so that there is always fluid flow from one side or the other during rolling maneuvers of the aircraft. The pair of fuel lines on each tank join together as a single line 20 and 22 from the left and right tanks respectively at a juncture with a conventional fuel selector value 24 and allows fuel to flow from either the right or left tank or both. The outlet from selector valve 24 connects with a fuel line 26 which in turn connects to a small fluid reservoir 28 which contains less than a gallon of fuel. Contained within reservoir 28 is a submerged electric auxiliary pump 30 which draws fuel from the lowest spot of reservoir 28. Outlet line 32 from auxiliary pump 30 includes a check valve 34 which permits bypass flow in the system when auxiliary pump 30 is inoperative. Also positioned in outlet line 32 is a low pressure relief valve 36, when ever needed, with an outlet remote from the auxiliary pump which permits auxiliary pump 30 to circulate fuel within the reservoir 28 without injecting vapor when fuel is not called for in the engine 12. Auxiliary pump 30 is a positive displacement conventional pump and if a centrifugal pump was substituted, relief valve 36 would not be required. The reservoir 28 and its above-described components is also referred to as an integrated module 54. Pump outlet line 32 connects with fuel line 38 as it passes through the fire wall 11 of the aircraft into a conventional fuel strainer 52. Fuel line 38 continues into the inlet of an engine-driven pump 16 which maintains a constant pressure level down stream therefrom through fuel line 40, vapor separator 60, fuel line 42, into fuel metering unit 14. Metering unit 14, which is controlled by the throttle and mixture control of the aircraft, supplies the engine with the required fuel for various throttle and mixture control positions.

Figure 2:
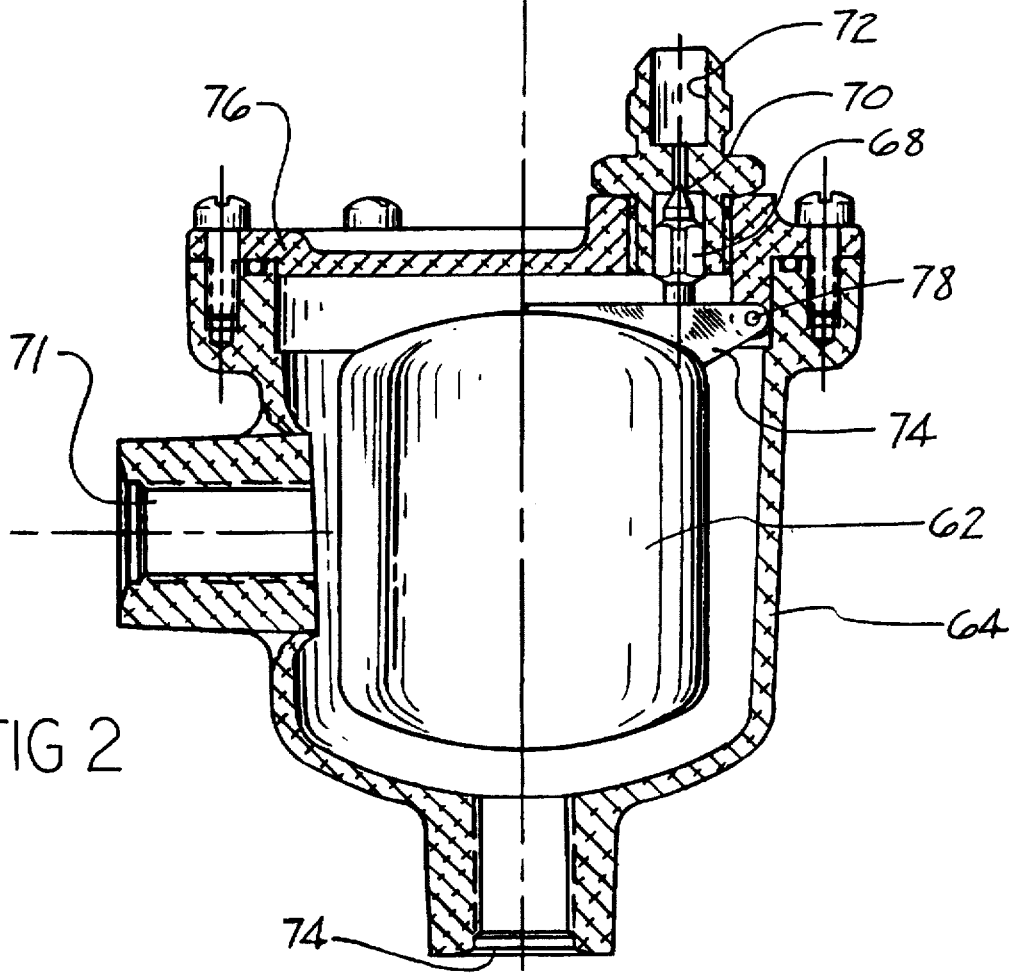
FIG. 2 is a detailed vertical section of the vapor separator taken along line 2—2 of FIG. 3.

FIG. 2 illustrates the vapor separator 60 in detail. Separator 60 includes a float 62 which is attached to an arm 74 and moves vertically, as seen in the drawing, to actuate a needle valve 68 into a valve seat 70. The body 64 of the vapor separator is cup-shaped and closed at one end by an end plate 76. Fuel flows into inlet port 71 from fuel line 40 and is discharged from the separator from liquid outlet port 74 located in the bottom of the separator. Outlet port 74 is in turn connected to a fuel line 42 as it flows into the fuel metering unit of the aircraft engine 14.

If there is no vapor in vapor separator 60, needle valve 68 is held closed by the buoyancy effect of float 62 in a separator completely filled with fluid. Separator 60 is positioned at a point higher than the downstream fuel line 42 and fuel metering unit 14 so that any vapor can rise into port 74 and collect in the top of the separator. Once sufficient vapor has displaced enough fluid in the separator, the float will drop, opening needle valve 68 which will vent vapor through port 72 and vapor vent line 44 back to the fuel tanks 18 and 19. Fuel tank ullage pressure is maintained at a relatively low differential by the low pressure relief valve 48 in fuel tank 19. Once sufficient vapor is vented through needle valve 68, float 62 will close the valve 68 prior to the passage of pressurized liquid fuel into vent line 44. Check valve 52 in tank 19 permits atmospheric air to enter the tanks as the fuel is being burned.

Figure 4:
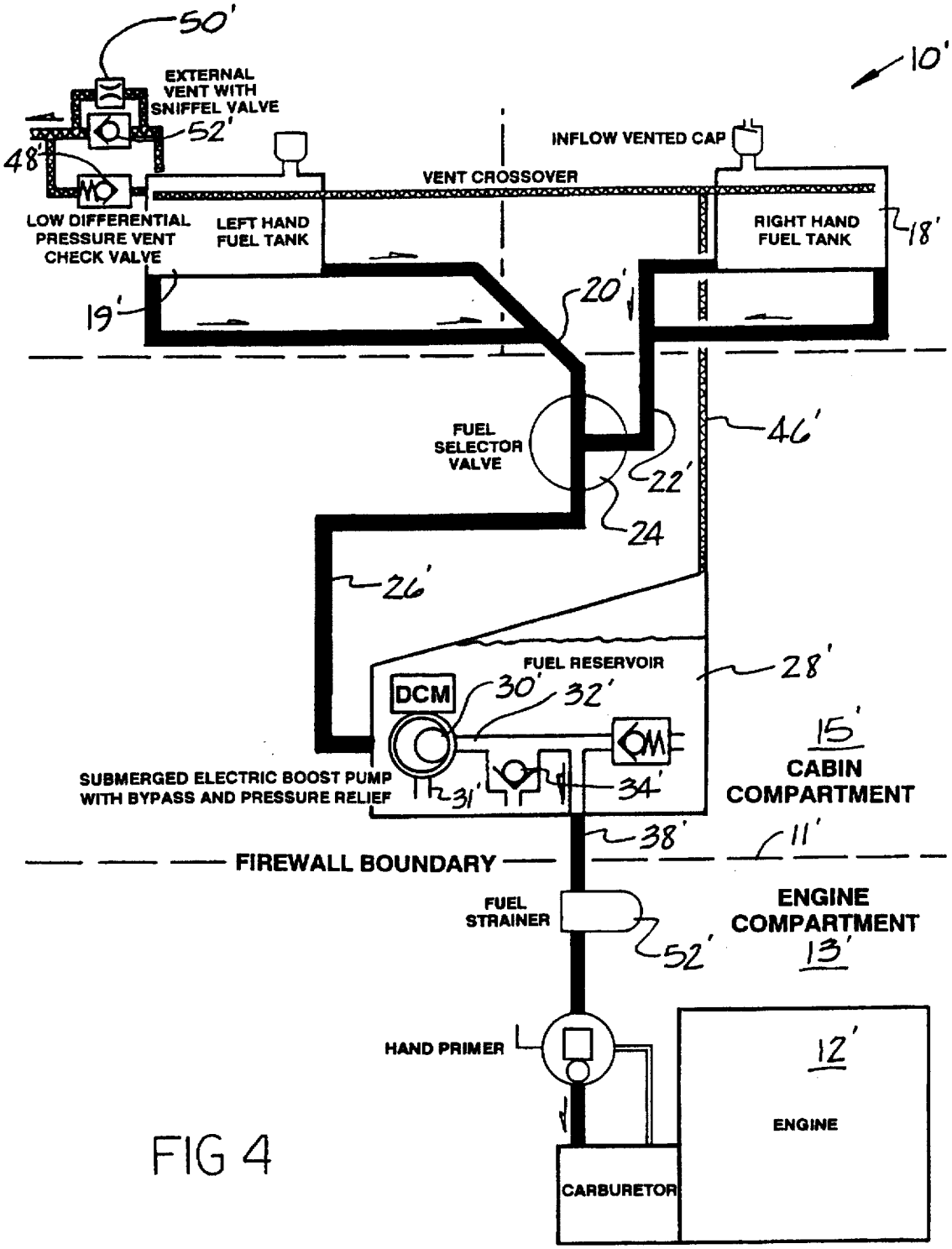
FIG. 4 is a schematic diagram of a modified fuel system utilized with a carburetor.

FIG. 4 is a modified fuel system for a carburetor engine which utilizes a similar integrated module 54' to that of FIG. 1. Fuel is supplied by gravity from tanks 18' and 19' through a selector valve 24' and fuel line 26' in the same manner as described in FIG. 1. Auxiliary pump 30' can be utilized on demand to supply the engine. In hot weather conditions with the more volatile fuels, the reservoir 28' vents any vapor collected in the reservoir 28' back to tanks 18' and 19' through vapor vent line 46'. Fuel from pump outlet line 32 connects with fuel line 38 and flows to carburetor 56 through fuel strainer 52' and hand primer 58.

The above is a detailed description of the preferred embodiment. The claims which follow define the scope of the invention to which applicant is entitled. It should be understood that applicant intends to cover all equivalence of the invention as defined in the claims as well as those items which fall specifically within the claim language.

I claim:

1. A fuel injection type aircraft fuel system for piston aircraft engines having an engine compartment separated from the aircraft by a fire wall, the improvement comprising the combination of:

a gravity flow fuel tank in the aircraft;

a pressurized fuel metering unit on the aircraft engine;

a fuel line connecting the metering unit to the fuel tank;

an engine driven pump in said line positioned in the engine compartment;

a vapor separator in said line between the engine driven pump and the fuel metering unit;

a first vapor vent line connecting the vapor separator to the fuel tank;

a fuel reservoir in said line between the fuel tank and the engine driven pump;

a submerged auxiliary pump in said reservoir to charge said fuel system;

an auxiliary pump bypass valve connected in parallel to said auxiliary pump; and a second vapor vent line connecting the reservoir to the fuel tank.

2. A fuel injection system, as set forth in claim 1, wherein the vapor separator is pressurized and includes a float operated valve which opens the vapor vent line when sufficient vapor fills the separator.

3. A fuel injection system as set forth in claim 1 wherein the fuel reservoir is positioned in close proximity to the fire wall.

4. An aircraft fuel system for piston aircraft engines having an engine compartment separated from the aircraft by a fire wall, the improvement comprising the combination of:

a gravity flow fuel tank in the aircraft;

a carburetor on the aircraft engine;

a fuel line connecting the carburetor to the fuel tank;

a fuel reservoir in said line in close proximity to the aircraft fire wall;

a vapor vent line connecting the fuel reservoir to the fuel tank;

a submerged auxiliary pump in said reservoir drawing fuel from the bottom of the reservoir with an outlet line extending out of the reservoir; and an auxiliary pump bypass valve positioned in the reservoir connected in parallel to said auxiliary pump.

5. A fuel injection system, as set forth in claim 4, wherein the bypass valve connects with the outlet line.

* * * * *